US008640914B2

(12) United States Patent
Meyer et al.

(10) Patent No.: US 8,640,914 B2
(45) Date of Patent: Feb. 4, 2014

(54) TAMPER-EVIDENT THERMOFORMED PACKAGE AND TAB ARRANGEMENT

(75) Inventors: Marc R. Meyer, Grand Rapids, MI (US); Gordon L. Beach, Muskegon, MI (US); Andrew J. Blackmore, Belmont, MI (US); David A. Korhorn, Rockford, MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

(21) Appl. No.: 13/442,910

(22) Filed: Apr. 10, 2012

(65) Prior Publication Data

US 2012/0292322 A1 Nov. 22, 2012

Related U.S. Application Data

(63) Continuation-in-part of application No. 29/392,281, filed on May 19, 2011, now Pat. No. Des. 664,842.

(51) Int. Cl.
*B65D 17/347* (2006.01)

(52) U.S. Cl.
USPC ..... 220/791; 220/790; 220/780; 220/270; 206/508

(58) Field of Classification Search
USPC ..... 220/226, 270, 4.21, 789–791, 780, 324; 206/508; 292/1, DIG. 11
See application file for complete search history.

(56) References Cited

U.S. PATENT DOCUMENTS

| | | | | |
|---|---|---|---|---|
| 7,338,209 | B2 | 3/2008 | Winpenny | |
| 7,568,589 | B2 | 8/2009 | Vovan | |
| 7,712,626 | B2 | 5/2010 | Vovan | |
| 7,992,743 | B2 | 8/2011 | Vovan | |
| 8,056,750 | B2 | 11/2011 | Vovan | |
| 8,123,064 | B2 | 2/2012 | Vovan | |
| 8,251,249 | B1 | 8/2012 | Vovan | |
| 8,256,636 | B2 | 9/2012 | Huffer | |
| 2006/0255054 | A1 | 11/2006 | Vovan | |
| 2007/0045317 | A1* | 3/2007 | Rosender et al. | 220/266 |
| 2007/0108210 | A1 | 5/2007 | Alvares et al. | |
| 2009/0206082 | A1 | 8/2009 | Vovan | |
| 2010/0181323 | A1* | 7/2010 | Thaler et al. | 220/574 |
| 2012/0292322 | A1 | 11/2012 | Meyer et al. | |

FOREIGN PATENT DOCUMENTS

| | | |
|---|---|---|
| EP | 1736417 | 10/2008 |

* cited by examiner

*Primary Examiner* — J. Gregory Pickett
*Assistant Examiner* — Mollie Llewellyn
(74) *Attorney, Agent, or Firm* — Warner Norcross & Judd LLP

(57) ABSTRACT

A tamper-evident tab construction for a thermoformed package. In one embodiment, the package includes top and bottom parts with overlapping tabs. The top and bottom parts may include locking tabs that interlock with one another and provide a structure for holding the package while it is being opened. The top part may also include a pull tab located proximate the locking tabs. The pull tab is configured to provide a structure for pulling the top part away from the bottom part to open the package. The pull tab may be joined to the top part by a small land of material that is configured to deform when the package is opened. As a result, the pull tab may remain at an angle after opening to provide a visual indication that the package may have been opened or tampered with.

12 Claims, 7 Drawing Sheets

TAMPER-EVIDENT THERMOFORMED PACKAGE AND TAB ARRANGEMENT

This application is a continuation-in-part of U.S. application Ser. No. 29/392,281, which is entitled "PACKAGE" and was filed on May 19, 2011, by Meyer et al., and which is incorporated herein by reference in its entirety.

BACKGROUND OF THE INVENTION

The present invention relates to packaging and more particularly to tamper-evident thermoformed packaging.

Thermoformed packaging is used in a wide variety of application. The design and construction of thermoformed packaging typically varies from application to application. One common application for thermoformed packaging is food packaging. For example, fruits and vegetables are now commonly sold in containers made from thermoformed parts. Although food packages may vary in design and construction, one type of common food package includes a thermoformed base and a thermoformed lid that can be closed to cooperatively define an article-receiving space. In some applications, the base and lid are formed from a single portion of thermoplastic material and are joined together along a living hinge. In other applications, the base and lid are separately formed.

The base and lid can be secured together using a variety of different options. For example, the base and lid can be permanently sealed (e.g. welded) together to make it difficult to open and therefore tamper with the content of the package. However, permanently sealed packaging has a number of disadvantages. For example, permanently sealing the package can increase the cost of packaging because it may require the use of relatively expensive sealing equipment (e.g. a welder). Further, consumers have increasingly expressed resistance to the use of permanently sealed thermoformed packaging. Permanently sealed packages can be difficult to open, thereby providing a source of frustration for consumers. As a result of these (and perhaps other) disadvantages, there has been an effort to develop alternative packaging constructions that are not welded or otherwise permanently sealed. Some alternative constructions currently in use include a base and a lid that are snap-fitted together, and can therefore be relatively easily opened and closed.

With food packaging (and some other applications), it can be desirable to provide a mechanism that allows a consumer to determine whether or not the package has been opened. With welded or otherwise permanently-sealed packages, the process of opening the package will typically leave an obvious visual indication that the package has been opened. With other types of packages, such as snap-locked packaging, special accommodations may be needed to provide a visual indication when desired. For example, some conventional food packages include a tear strip that must be removed from a package before it can be opened. Removal of the tear strip leaves an unmistakable visual indication that the package has been opened. Tear strips provide some advantages, but they can increase the overall cost of the package, as well as present difficulties during use.

SUMMARY OF THE INVENTION

The present invention provides a tamper-evident tab construction for a thermoformed package that facilitates opening of the package in a way that will typically provide a visual indication that the package has been opened. In one embodiment, the package includes top and bottom parts with overlapping tabs. The tabs are configured to provide a structure to facilitate opening of the package through a process that causes at least one of the tabs to provide a visual indication that the package has been opened.

In one embodiment, the top and bottom parts include locking tabs that interlock with one another and provide a structure for holding the package while it is being opened. The top part may also include a pull tab located proximate the locking tabs. The pull tab is configured to provide a structure for pulling the top part away from the bottom part to open the package. The pull tab may be joined to the top part by a small land of material that is configured to deform when the package is opened. As a result of the deformation, the pull tab may be oriented at a different angle to the package after opening. The different orientation of the pull tab may provide a visual indication that the package has been opened or otherwise tampered with.

In one embodiment, the top locking tab is separably joined to the top part of the package so that it is separated from the top part when the package is opened. Separation of the locking tab from the top part may provide additional visual evidence that the package has been opened or tampered with. In one embodiment, a line of perforations may be formed between the top locking tab and the top part to facilitate separation of the top locking tab.

In one embodiment, the locking tabs are configured to snap-lock together. The snap-locks may be configured so that the force required to separate the locking tabs from one another is greater than the force required to separate the top locking tab from the top part.

In one embodiment, the pull tab is separably joined to the top locking tab. For example, the top locking tab and pull tab may be joined by a line of perforations. The line of perforations may be configured to easily break away when the pull tab is lifted to open the package. The bottom locking tab may be configured to extend below the line of perforations joining the pull tab to the top locking tab. In this way, the bottom locking tab may reduce the likelihood that the line of perforations will be inadvertently broken prior to opening.

In one embodiment, the top and bottom parts are separately manufactured and include interlocking features that allow them to be snap-fitted together to close the package. The top and bottom parts may include interlocking structures that extend entirely around the periphery of each part. The interlocking structure may include a shoulder and a channel that are configured to interlock.

In one embodiment, the tabs are disposed in a corner of the package. The package may be shaped so that the tabs are recessed inwardly from the general peripheral of the container. For example, the package may include a truncated corner in which the tabs may be disposed.

In one embodiment, the tabs are joined to the package along the peripheral edge of the top and bottom parts. The peripheral edge of the package may be curved and the land joining the pull tab to the top part may be disposed at the outermost point of the curve. As a result, operation of the pull tab causes the top and bottom parts to begin to separate through a relatively small region, thereby reducing the force required to open the container.

The present invention provides a simple and effective tab construction that is generally tamper-evident. The tab construction provides structure for opening the package and doing so in a way that provides a visual indication once the package has been opened or otherwise tampered with. The pull tab provides a structure for easily pulling the top part away from the bottom part to open the package. The locking tabs provide a sure structure for gripping the package during opening. When desired, a line of perforations can be provided to allow the top locking tab to separate from the top part when the package is opened. Joining the pull tab to the top part by a land that is readily deformed can increase the likelihood that the pull tab will remain at an angle after opening. It can also facilitate opening by focusing the opening force along relatively small region of the interlocking structure. The bottom locking tab may be shaped to protect the line of perforations between the pull tab and the top locking tab to reduce the likelihood that the pull tab will be inadvertently separated from the top locking tab, which could provide a false indication that the package has been opened.

These and other features of the invention will be more fully understood and appreciated by reference to the description of the embodiments and the drawings.

BRIEF DESCRIPTION OF THE DRAWINGS

FIG. 10 is an enlarged perspective view of a portion of a closed package after it has been opened or otherwise tampered with.

Figure 1:
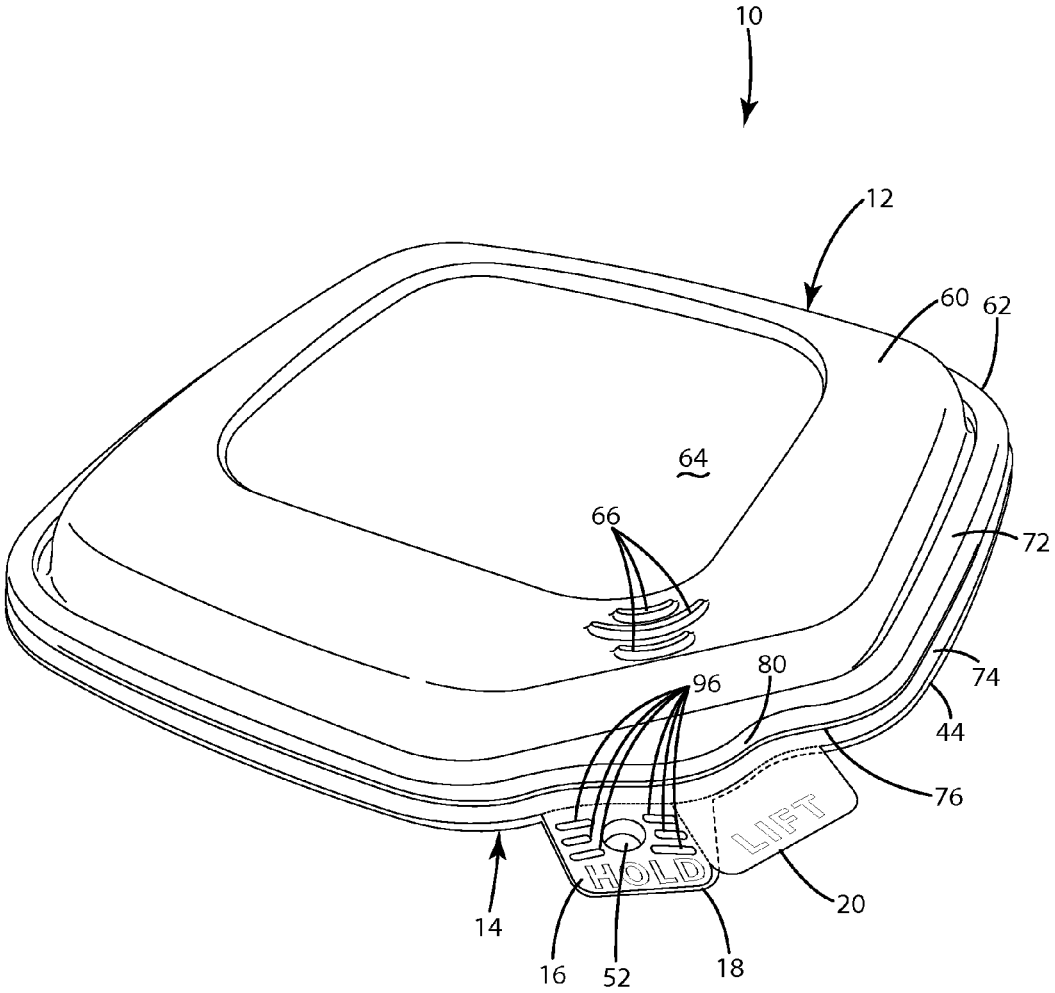
FIG. 1 is a perspective view of a package in accordance with an embodiment of the present invention.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF CURRENT EMBODIMENTS

Figure 2:
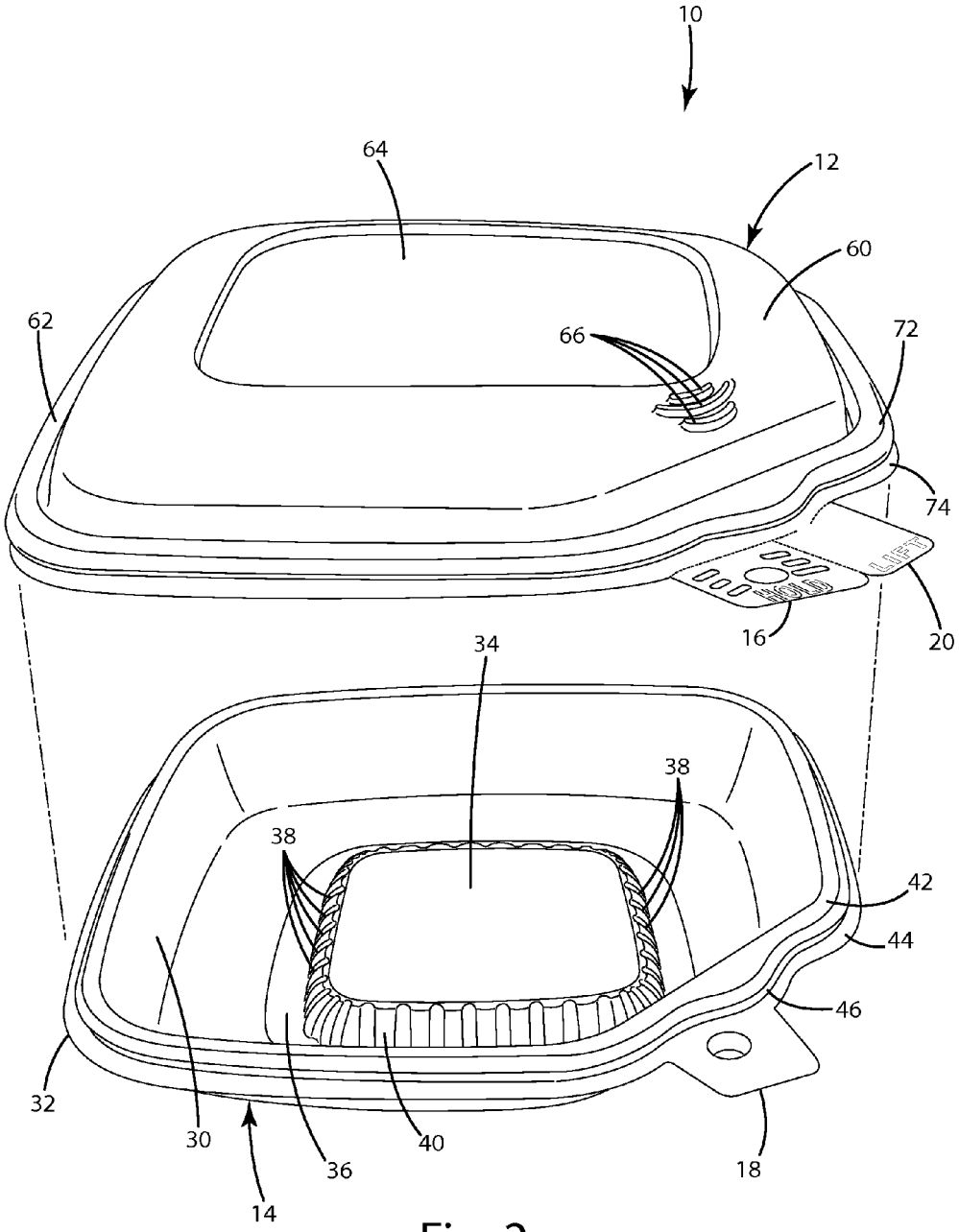
FIG. 2 is an exploded perspective view of the package with the top and bottom parts separated.

A package in accordance with an embodiment of the present invention is shown in FIGS. 1 and 2. The package 10 includes a top part 12 and a bottom part 14. The top and bottom parts 12, 14 are configured to be closed together to form a closed package with an internal article-receiving space. For example, as shown, the top and bottom parts 12, 14 may include interlocking structures that allow the top part 12 and bottom part 14 to be snap-fitted together. The top and bottom parts 12, 14 may include an arrangement of overlapping tabs that provide a structure for opening the package 10 in a way that will typically leave a visual indication that that the package 10 has been opened or otherwise tampered with. In this embodiment, the overlapping tabs may include a top locking tab 16, a bottom locking tab 18 and a pull tab 20. The top and bottom locking tabs 16, 18 of this embodiment are configured to snap-lock together and to cooperatively provide a structure for holding the package 10 while it is being opened. The pull tab 20 of this embodiment is configured to provide a structure for pulling the top part 12 away from the bottom part 14 to open the package 10. The pull tab 20 may be joined to the top part 12 in a way that will generally leave the pull tab 20 at angle after the package 10 has been opened or otherwise tampered with. Further, the top locking tab 16 may be configured to separate from the top part 12 when the package 10 is opened or otherwise tampered with. Separation of the top locking tab 16 from the top part 12 may provide a visual indication that the package 10 has been previously opened or otherwise tampered with.

Although the present invention is described in connection with a package 10 intended for use in packaging food, such as fruits or vegetables, the present invention may be implemented in connection with packages intended for use in packaging other items. The size, shape and configuration of the package may vary from application to application, as desired. For example, the width, depth or shape of the top and/or bottom parts may be varied to accommodate essentially any item or items to be packaged. The illustrated package 10 is intended to provide point-of-sale or point-of-purchase packaging for articles, but the present invention may be implemented in other types of packaging, if desired. It should also be noted that the present invention is illustrated in connection with a package 10 having separate top and bottom parts 12, 14. Alternatively, the present invention may be incorporated into a clamshell package in which the top and bottom parts are joined along a living hinge.

Directional terms, such as "vertical," "horizontal," "top," "bottom," "upper," "lower," "inner," "inwardly," "outer" and "outwardly," are used to assist in describing the invention based on the orientation of the embodiment or embodiments shown in the illustrations. The use of directional terms should not be interpreted to limit the invention to any specific orientation(s).

Figure 3:
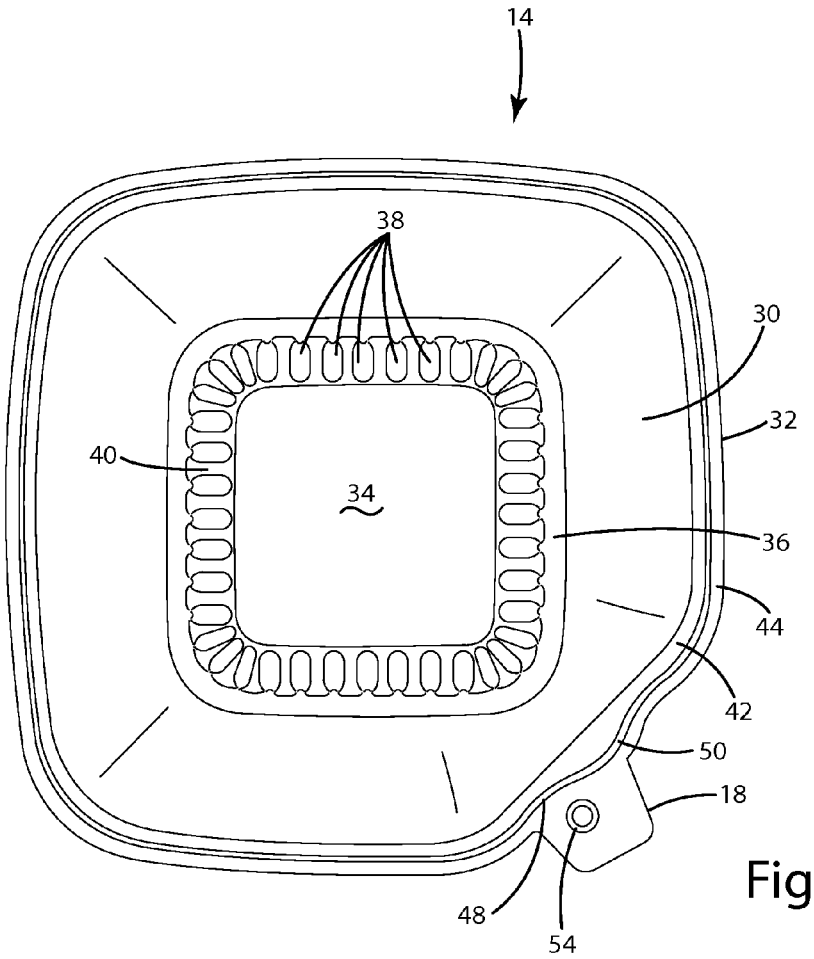
FIG. 3 is a top plan view of the bottom part.
Figure 4:
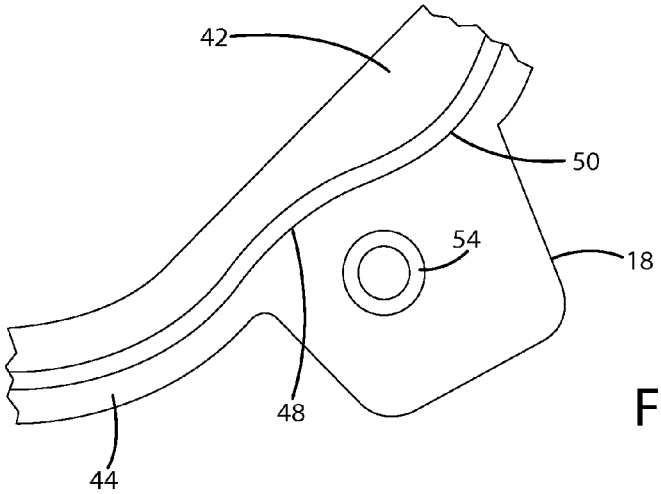
FIG. 4 is an enlarged view of a portion of the bottom part.

As noted above, the package 10 of FIGS. 1 and 2 includes separate top and bottom parts 12, 14 that are joined to form the closed package. In this embodiment, the top and bottom parts 12, 14 are configured to snap-lock together to cooperatively define an internal space for receiving an item or items to be packaged. In the illustrated embodiment, the bottom part 14 is configured to contain the bulk of the packaged article(s) and the top part 12 is configured to provide a relatively shallow lid for the bottom part 14. It should be understood that the relative size and shape of the top and bottom parts 12, 14 may vary from application to application. For example, the bottom part may alternatively be a relatively shallow tray and the top part may form a relatively deep cover that contains the bulk of the packaged article(s). Referring now to FIGS. 3 and 4, the bottom part 14 of the illustrated embodiment generally includes a bowl portion 30 that terminates in a flange portion 32. In this embodiment, the bowl portion 30 includes a base 34 having a trough 36. The trough 36 may, among other things, provide a place to accumulate fluid, such as water that may run off of packaged fruits or vegetables. The trough 36 may also strengthen the bowl portion 30. The size, shape and configuration of the trough 36 may vary from application to application, as desired. The trough 36 may be eliminated when not desired. As perhaps best shown in FIG. 2, the trough 36 may include a plurality of ribs 38 extending along the inner wall 40. The ribs 38 are included primarily to add strength to the inner wall 40. The size, shape and configuration of the ribs 38 may vary from application to application, and may be eliminated, if desired.

Figure 11:
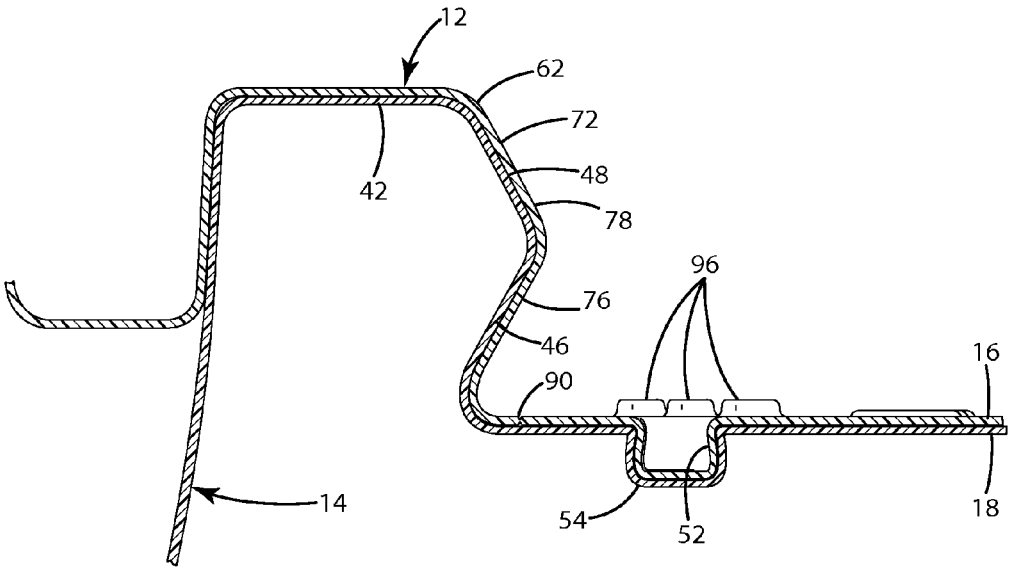
FIG. 11 is a sectional view taken along line XI-XI of FIG. 6.

In this embodiment, the flange portion 32 extends outwardly from the periphery of the bottom part 14 along the upper edge of the bowl portion 30. The flange portion 32 of this embodiment generally includes a shoulder 42 and a bottom lip 44. The shoulder 42 of this embodiment is continuous and is configured to extend around the periphery of the bottom part 14. The shoulder 42 may, however, be discontinuous or otherwise extend through only one or more portions of the periphery of the package 10. As perhaps best shown in FIG. 11, the shoulder 42 may be formed with an undercut 46 that allows the shoulder 42 and the channel 72 (described below) to be snap-locked together. The size, shape and configuration of the undercut 46 may be varied to control the amount of force required to separate the top and bottom parts 12, 14. The bottom lip 44 extends outwardly from the outer edge of the shoulder 42. The size, shape and configuration of the bottom lip 44 may vary from application to application as desired. In this embodiment, the bottom lip 44 is continuous and extends entirely around the periphery of the shoulder 42. It may alternatively be discontinuous or extend through only one or more portions of the package 10. In some applications, the bottom lip 44 may be eliminated.

In the illustrated embodiment, the overlapping tabs 16, 18 and 20 are located in a corner of the package 10. The tabs 16, 18 and 20 may be located in other positions as desired. In the illustrated package 10, one corner of the package 10 is truncated to provide for the tabs 16, 18 and 20. As shown, the shoulder 42 may be specially shaped in the truncated corner to facilitate use of the tabs 16, 18 and 20. More specifically, the outer surface 48 of the shoulder may be curved to provide a structure that is more easily opened by the pull tab 20. As shown, in this embodiment, the outer surface 48 includes contour 50 that is configured to provide an outermost region that is generally aligned with the land 82 of pull tab 20 when the package 10 is closed. In use, the contour 50 allows separation of the top part 12 from the bottom part 14 to be initiated over a relatively short region of the shoulder 42 and channel 72. This can reduce the amount of force required to separate the top part 12 from the bottom part 14 when the package 10 is opened properly using the pull tab 20.

As noted above, the bottom part 14 also includes locking tab 18 configured to interlock with the locking tab 16 of the top part 12. As shown, the locking tab 18 of this embodiment extends from the truncated corner of the package 10. More specifically, the locking tab 18 extends from the bottom lip 44 through a portion of the truncated corner. To facilitate interlocking, the top and bottom locking tabs 16, 18 may include locking features. In this embodiment, the locking features include a pair of nesting buttons 52 and 54. The top locking tab 16 includes the inner nesting button 52 and the bottom locking tab 18 includes the outer nesting button 54. As perhaps best shown in FIG. 11, the inner nesting button 52 is snap-fitted into the outer nesting button 54 to interlock the two locking tabs 16, 18. As can be seen, the walls of the nesting buttons 52, 54 may have a reverse draft that allows the nesting buttons 52, 54 to firmly interlock. In this embodiment, the nesting buttons 52, 54 are configured so that the force required to separate the nesting buttons 52, 54 is greater than the force required to separate the top locking tab 16 from the top part 12. Although not necessary, this allows the top locking tab 16 to separate from the top part 12 when the package 10 is opened even if the user is not properly holding together the locking tabs 16, 18. The size, shape and configuration of the locking features, including the amount of reverse draft, may vary from application to application. For example, the locking features may include a different number of snap locking elements and/or the shape of the locking element may vary.

Figure 5:
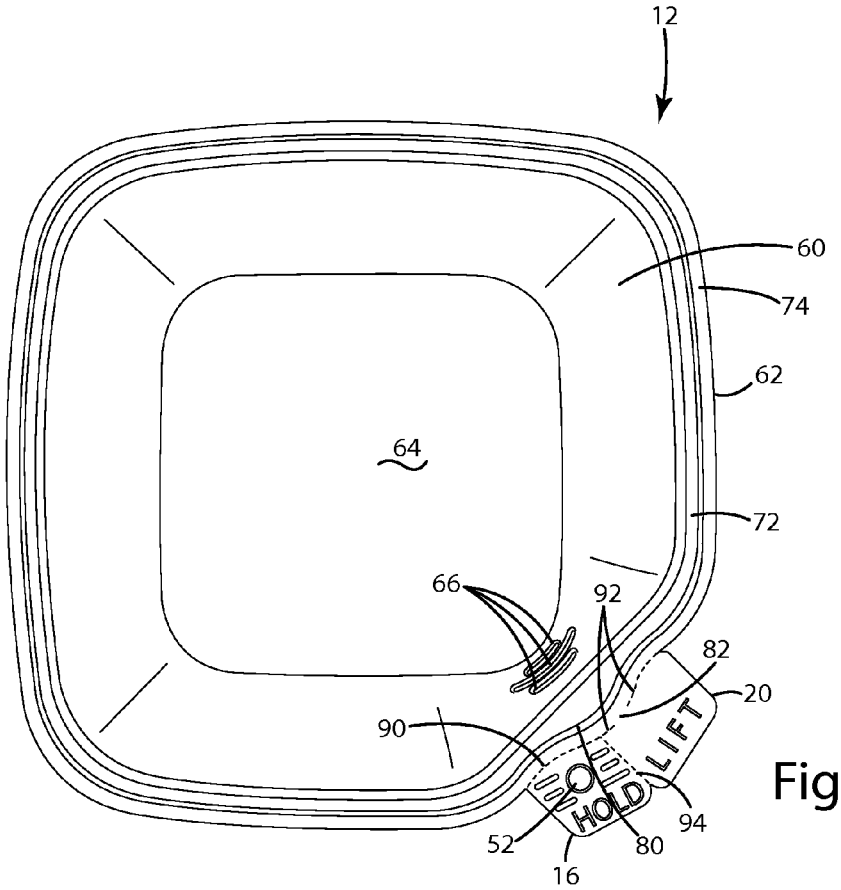
FIG. 5 is a top plan view of the top part.
Figure 6:
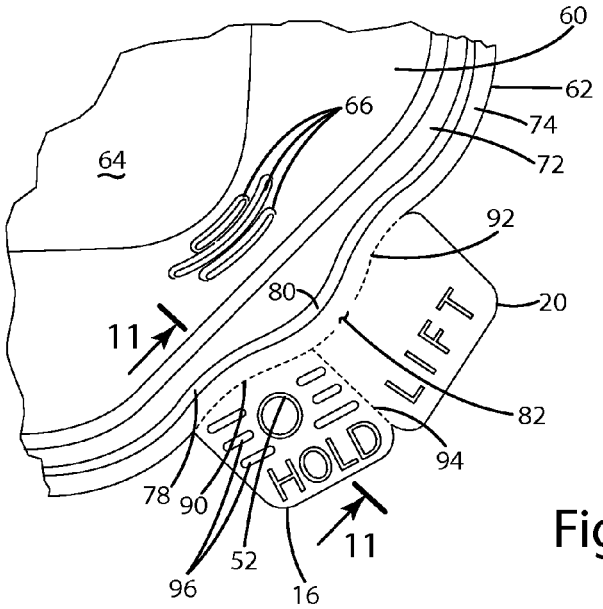
FIG. 6 is an enlarged view of a portion of the top part.
Figure 8:
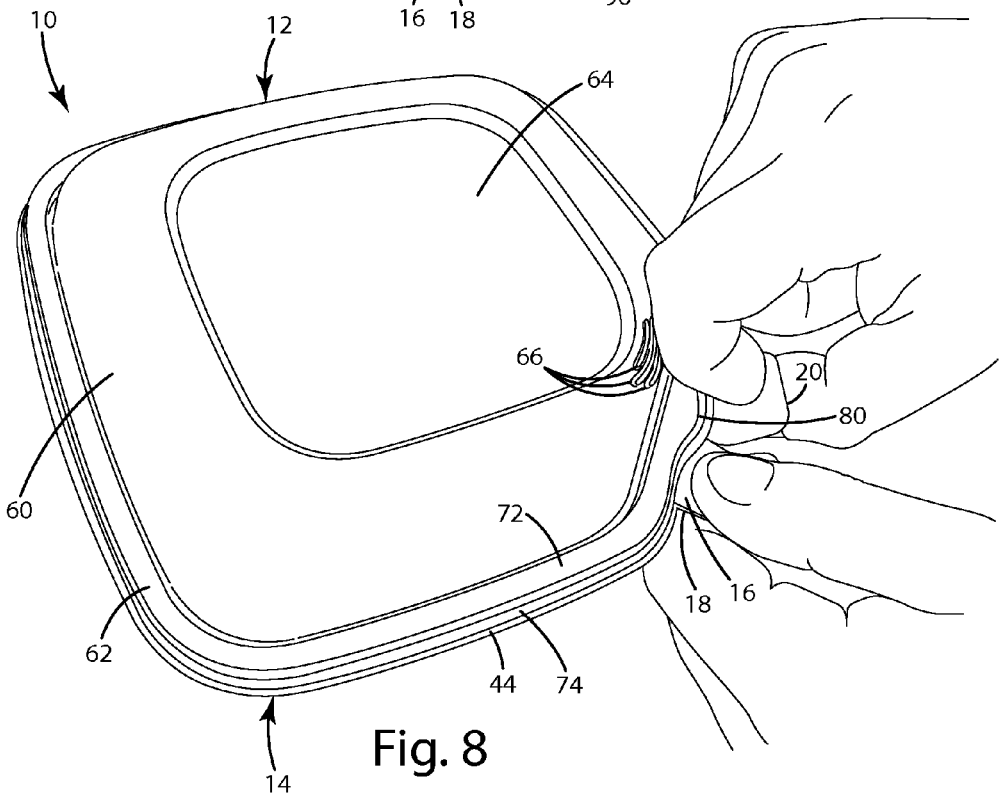
FIG. 8 is a perspective view showing a user beginning to open the package.
Figure 9:
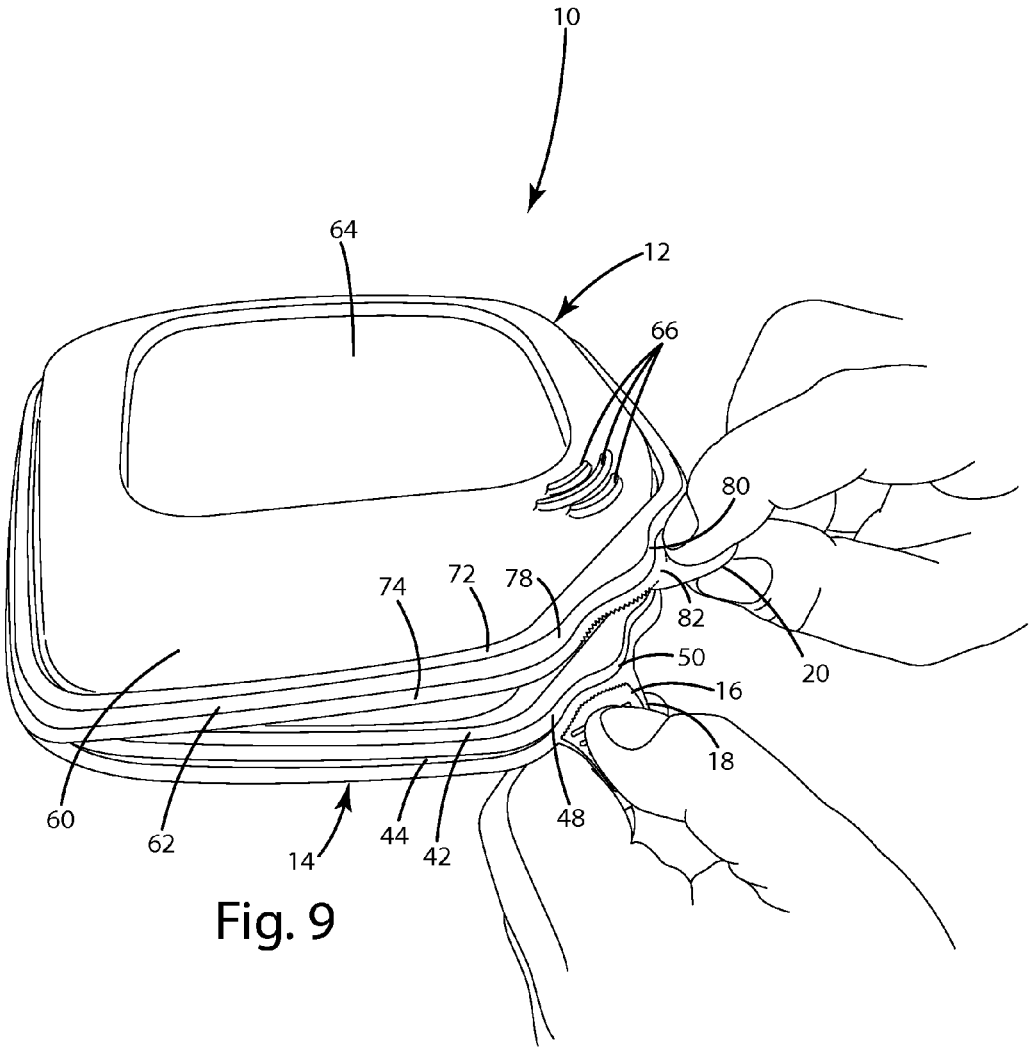
FIG. 9 is a perspective view showing the package part way through the opening process.

As noted above, top part 12 is configured to interlock with the bottom part 14 to form the closed package 10. Referring now to FIGS. 5 and 6, the top part 12 is generally dome-shaped having a dome portion 60 and a flange portion 62. The dome portion 60 of this embodiment is sized and shaped to correspond with and complement the bowl portion 30 of the bottom part 14. The dome portion 60 may include a recess 64 that is configured to allow nesting of stacked packages. For example, in this embodiment, the trough 36 extends downwardly from the bottom of the bottom part 14, and is configured to be received closely within the recess 64 when packages are stacked one atop the other. The recess 64 may also add some strength to the dome portion. The size, shape and configuration of the recess 64 may vary from application to application. The recess 64 may be eliminated when desired. The dome portion 60 may also include ribs 66 that assist in opening the package 10 by providing a visual indication of where a user may engage the top part 12 when opening the package 10. For example, as shown in FIGS. 8 and 9, the user may place a knuckle against the ribs 66 while lifting the pull tab 20 to separate the top and bottom parts 12, 14.

In this embodiment, the flange portion 62 of the top part 12 extends outwardly from the periphery of the top part 12 along the lower edge of the dome portion 60. The flange portion 62 of this embodiment generally includes a channel 72 and a top lip 74. The channel 72 of this embodiment is continuous and is configured to extend around the periphery of the top part 12. The channel 72 may, however, be discontinuous or otherwise extend through only one or more portions of the periphery of the package 10. As can be seen, the channel 72 corresponds in size, shape and configuration with the shoulder 42 of the bottom part 14. As perhaps best shown in FIG. 11, the channel 72 may be formed with an undercut 76 that corresponds with the undercut 46 in the shoulder 42 to allow the channel 72 and shoulder 42 to snap-lock together. The size, shape and configuration of the channel 72 and shoulder 42 may be selected to set the amount of force required to separate the top and bottom parts 12, 14. For example, deeper undercuts or undercuts on both the inner and outer surfaces of the shoulder 42 and channel 72 may be used to increase the force required to open the package 10. As another example, the thickness of the material used to the form the top and bottom parts 12, 14 can be reduced to decrease the amount of force required to open the package 10. Similar to the bottom lip 44 of the bottom part 14, the upper lip 74 extends outwardly from the outer edge of the channel 72. The size, shape and configuration of the upper lip 74 may vary from application to application as desired. In this embodiment, the upper lip 44 is continuous and extends entirely around the periphery of the top part 12. It may alternatively be discontinuous or extend through only one or more portions of the top part 12. The upper lip 74 may be sized so that it does not extend outwardly as far as the bottom lip 44. As a result, it may be difficult for a user to grip the upper lip 44 in an effort to open the package 10. This will encourage the user to grip the pull tab 20 to open the package 10 in the intended manner.

As with the bottom part 14, the tabs 16 and 20 are located in a corner of the top part 12, but can alternatively be located in other positions as desired. In the illustrated embodiment, the tabs 16 and 20 are located in a corner of the top part 12 that is truncated to provide for the tabs 16 and 20. In this embodiment, the top locking tab 16 and pull tab 20 extend from the upper lip 74 in the truncated corner of the package 10. Although shown as being immediately adjacent one another, the top locking tab 16 and the pull tab 20 may alternatively be spaced apart from one another. As perhaps best shown in FIG. 7, the top locking tab 16 and pull tab 20 overlap the bottom locking tab 18. As noted above, the top locking tab 16 of this embodiment includes inner nesting button 52, but may include alternative locking structure, if desired. The top locking tab 16 may also include ribs 96 or structure that helps a user grip the locking tabs 16, 18 when the package 10 is opened.

Figure 7:
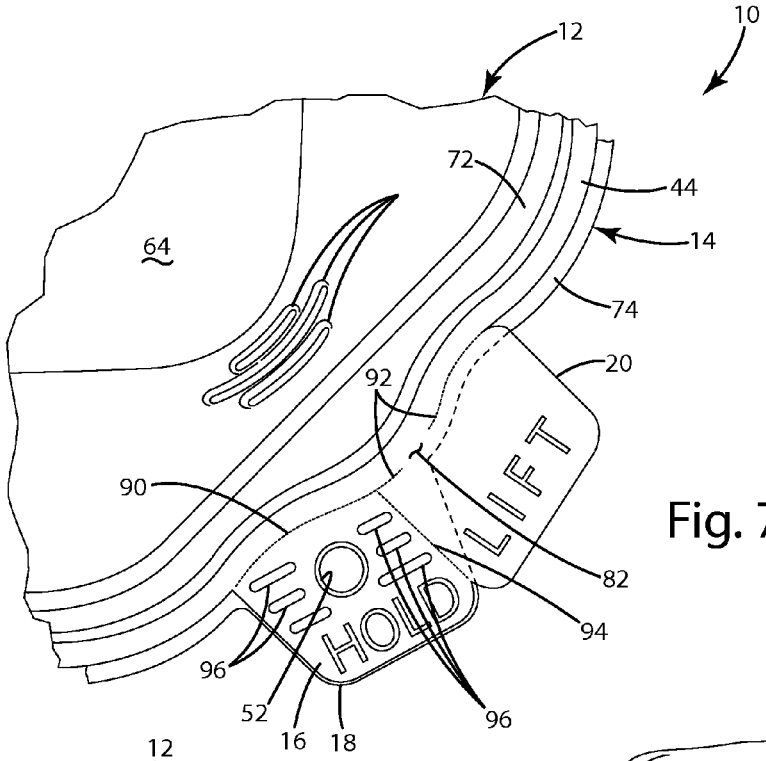
FIG. 7 is an enlarged view of a portion of the package.

As perhaps best shown in FIGS. 6 and 7, the top locking tab 16 may be joined to the upper lip 74 by a first line of perforations 90. The first line of perforations 90 may be configured to allow the top locking tab 16 separate from the upper lip 74 when the package 10 is opened. In this embodiment, the first line of perforations 90 extends substantially parallel to the outer surface 78 of the channel 72, but it may follow a different shape. The first line of perforations 90 is configured to provide the desired amount of resistance to separation of the top locking tab 16 from the top part 12. The first line of perforations 90 may be replaced by other structure intended to allow separation of the locking tab 16, such as a partial die cut or other line of weakening. The pull tab 20 of this embodiment is joined to the upper lip 74 by a second line of perforations 92 and to the top locking tab 16 by a third line of perforations 94. The second line of perforations 92 is configured to allow the pull tab 20 to separate partially from the upper lip 74 when the package 10 is opened. The third line of perforations 94 is configured to allow the pull tab 20 to separate fully from the locking tab 16 when the package 10 is opened. In this embodiment, the second line of perforations 92 has a short break that defines a land 82 adjacent to the contour 80 in the channel 72. The land 82 is configured to maintain a connection between the pull tab 20 and the upper lip 74 as the package 10 is opened even after the second and third lines of perforations 92, 94 have been broken. Additionally, in this embodiment, the land 82 is configured to deform under the force required to open the package 10. As a result, the pull tab 20 is likely to extend at an angle to its original position once the pull tab 20 has been used to pull open the package 10. Accordingly, the pull tab 20 will generally provide a visual indication once the package 10 has been opened or tampered with in a way that deforms the land 82. As with the first line of perforations 90, the second and third lines of perforations 92, 94 may be replaced by other structure intended to allow separation of the pull tab 20 from the locking tab 16 and upper lip 74, such as a partial die cut or other line of weakening.

As described above in connection with the bottom part 14, the shoulder 42 and channel 72 may be specially shaped in the truncated corner to facilitate use of the tabs 16, 18 and 20. As shown, the outer surface 78 of the channel 72 may be curved to provide a structure that is more easily opened by the pull tab 20. In this embodiment, the outer surface 78 includes contour 80 having an outermost portion that is aligned with the land 82 of pull tab 20. In use, the pull tab 20 pulls directly on the outermost portion of the contour 80 to allow the channel 72 to pull away from the shoulder 42 along a relatively short portion. As noted above, this can significantly reduce the amount of force required to separate the top part 12 from the bottom part 14.

In this embodiment, the second and third lines of perforations 92, 94 help to hold the pull tab 20 in its original position to reduce the likelihood that the pull tab 20 will be inadvertently moved into an angled position prior to opening. This may help to reduce the risk of a false visual indication that the package 10 has been opened or otherwise tampered with. In some applications, the second and/or third lines of perforations 92, 94 may be replaced by full die cuts so that in the manufactured state the pull tab 20 is entirely separated from the locking tab 16 and/or the pull tab 20 is separated from the upper lip 44, except by land 82.

In this embodiment, the package 10 may be constructed to help protect the first, second and third lines of perforations 90, 92 and 94 from being inadvertently broken prior to opening. As perhaps best shown in FIG. 7, the lower lip 44 and bottom locking tab 18 extend beneath and protect the first line of perforations 90. The lower lip 44 also extends beneath and protects the second line of perforations 92. Similarly, the bottom locking tab 18 is shaped to extend beneath and protect the third line of perforations 94. The bottom locking tab 18 may also be slightly larger than that the top locking tab 16 making it more difficult for a user to grip the top locking tab 18, which will encourage a user to pull on the pull tab 20 when opening the package 10. The extended bottom locking tab 18 may also reduce the likelihood that the top locking tab 18 will inadvertently catch on an external structure prior to opening.

The top and bottom parts 12, 14 may be thermoformed, and are typically constructed from polyvinyl chloride (PVC) or polyethylene terephthalate (PET, PETE) or some other formable polymer. Although the material is typically transparent, translucent or clear, the stock may also be opaque, clouded or tinted any suitable color. The top and bottom parts 12, 14 will vary in thickness from application to application. For standard applications, the top and bottom parts 12, 14 are likely to have a thickness ranging between 12 and 30 gauge (i.e., 12 to 30 thousands of an inch). The top and bottom parts 12, 14 of a package 10 may have the same thickness, or they may vary in thickness, as desired.

Operation of the tamper-evident tab construction will now be described with reference to FIGS. 1, 7, 8, 9 and 10. The closed package 10 is shown in FIG. 1. An enlarged view of the tab construction in the closed package is shown in FIG. 7. As can be seen, the top part 12 and bottom part 14 are snap-locked together by interaction of channel 72 and shoulder 42. When closed, the top locking tab 16 and bottom locking tab 18 are interlocked by snap-fitting inner nesting button 52 into outer nesting button 54. In this condition, the top locking tab 16 is joined to the upper lip 74 by the first line of perforations 90 and to the pull tab 20 by the third line of perforations 94. Additionally, the pull tab 20 extends parallel to the locking tabs 16, 18 and remains attached to the upper lip 74 by the second line of perforations 92 and the land 82.

The package 10 may be opened in a variety of ways, but one method is shown in FIG. 8. As shown in FIG. 8, a user may grip the locking tabs 16, 18 with one hand and may grip the pull tab 20 with the other hand. The user may then pull up on the pull tab 20 while holding the locking tabs 16, 18 together with the other hand. The user's knuckle may engage the ribs 66 in the top part 12. As the pull tab 20 is pulled, the land 82 will cause the pull tab 20 to pull outwardly and upwardly on the outermost region of contour 80, which will begin to separate the outermost region of contour 80 from the outermost region of the contour 50 in the shoulder 42. As noted above, this will allow the top and bottom parts 12, 14 of the package 10 to begin to separate along a relatively small region of the shoulder 42 and channel 72, which will reduce the amount of force needed to start separation.

Figure 10:
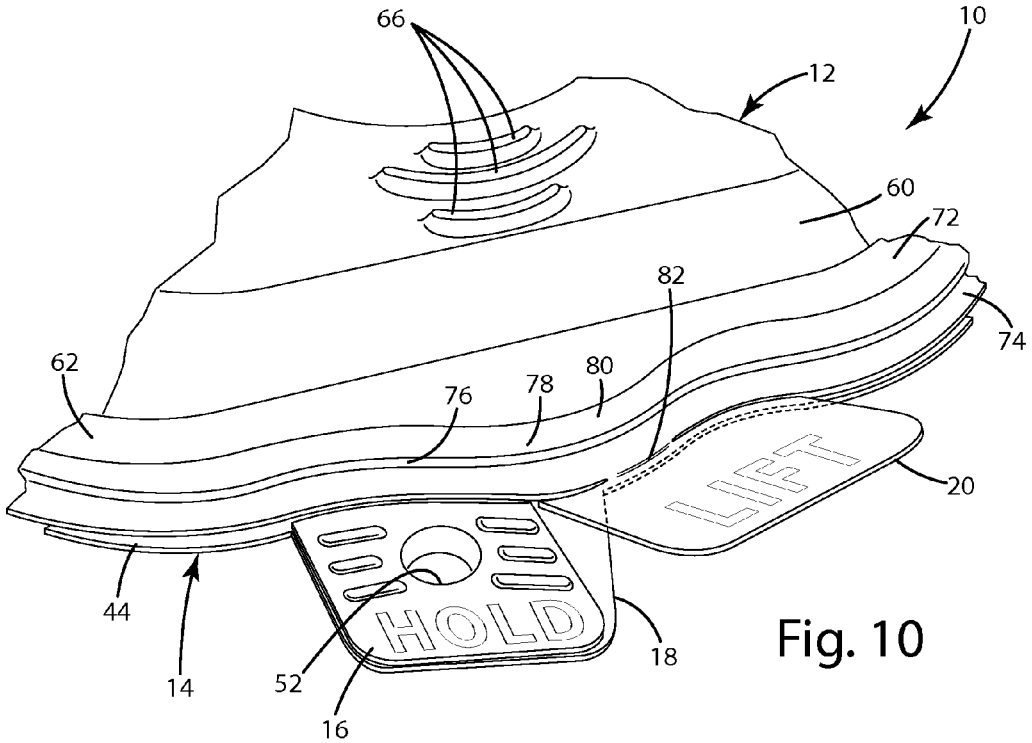

As the user continues to pull up on the pull tab 20, the top part 12 will continue to separate from the bottom part 14 as shown in FIG. 9. The top locking tab 16 is held together with the bottom locking tab 18, and remains secured to the bottom locking tab 18 by nesting buttons 52, 54. This causes the top locking tab 16 to eventually separate from the top part 12 as can be seen in FIG. 9. The direction and amount of force required to pull the top part 12 away from the bottom part 14 causes the land 82 to deform. As a result, the pull tab 20 is unlikely to continue to continue to extend parallel to the locking tabs 16, 18 in its original position after the package 20 has been opened. Instead, the pull tab 20 is likely to extend at an angle to its original position after the package has been opened. FIG. 10 illustrates an example of how the tab construction of the illustrated embodiment may appear if the package 10 is reclosed after it has been opened or otherwise tampered with in a way that deforms land 82. As can be seen, the tab construction of this embodiment provides several visual indications that the package 10 has been opened or otherwise tampered with. First, the pull tab 20 extends at an angle to its original position. The new orientation of the pull tab 20 provides a rather obvious visual indication. Second, the first and third lines of perforations 90, 94 have been broken so that the top locking tab 16 is separated from the top part 12 and the pull tab 20. And third, the second line of perforations 92 have been broken so that the pull tab 20 is separate from the top part 12, except at land 82. In alternative embodiments, the tab arrangement may be configured to provide different visual indications. For example, the second and/or third lines of perforations 92, 94 may be replaced by complete die cuts, thereby eliminating the visual indications presented by broken lines of perforations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A tab arrangement for a thermoformed package having first and second parts adapted to selectively open and close, comprising:

a first locking tab extending from the first part, said first locking tab separably joined to the first part, said first locking tab having a first interlocking element;

a pull tab extending from the first part;

a second locking tab extending from the second part, said first locking tab and said second locking tab at least partially overlapping, said second locking tab having a second interlocking element, said first interlocking element and said second interlocking element interlocked with one another to intersecure said first locking tab and said second locking tab, wherein the first part can be separated from the second part to open the package by gripping the locking tabs and pulling on the pull tab and wherein said first locking tab is configured to separate from the first part when the package is opened; and a peripheral edge of the first part, said peripheral edge of the first part including a contour with an outermost region, said pull tab connected to said outermost region by a land, wherein said pull tab is joined to the first part by the land, said land being configured with sufficient strength to maintain a connection between said pull tab and the first part when the package is opened.

2. A tab arrangement for a thermoformed package having first and second parts adapted to selectively open and close, comprising:

a first locking tab extending from the first part, said first locking tab separably joined to the first part, said first locking tab having a first interlocking element;

a pull tab extending from the first part; and a second locking tab extending from the second part, said first locking tab and said second locking tab at least partially overlapping, said second locking tab having a second interlocking element, said first interlocking element and said second interlocking element interlocked with one another to intersecure said first locking tab and said second locking tab, wherein the first part can be separated from the second part to open the package by gripping the locking tabs and pulling on the pull tab and wherein said first locking tab is configured to separate from the first part when the package is opened, wherein said pull tab is separably joined to the first part by a second line of perforations configured to break when the package is opened.

3. A tab arrangement for a thermoformed package having first and second parts adapted to selectively open and close, comprising:

a first locking tab extending from the first part, said first locking tab separably joined to the first part, said first locking tab having a first interlocking element;

a pull tab extending from the first part; and a second locking tab extending from the second part, said first locking tab and said second locking tab at least partially overlapping, said second locking tab having a second interlocking element, said first interlocking element and said second interlocking element interlocked with one another to intersecure said first locking tab and said second locking tab, wherein the first part can be separated from the second part to open the package by gripping the locking tabs and pulling on the pull tab and wherein said first locking tab is configured to separate from the first part when the package is opened, wherein said pull tab is separably joined to said first locking tab by a third line of perforations configured to break when the package is opened.

4. The tab arrangement of claim 3 wherein said second locking tab and said third line of perforations overlap.

5. A package comprising:

a first part having a first locking tab and a pull tab, said first locking tab separably joined to said first part, said first locking tab including a first interlocking element; and a second part adapted to selectively open and close with said first part, said second part having a second locking tab, said first part and said second part being selectively closable to define an interior article-receiving space, said second locking tab including a second interlocking element configured to interlock with said first interlocking element to selectively intersecure said first locking tab and said second locking tab, wherein said first part and said second part may be separated to open the package by holding said locking tabs and pulling on said pull tab, said first locking tab separating from said first part when said first part is separated from said second part, wherein said first part includes a truncated corner, said first locking tab and said pull tab extending from said truncated corner; and wherein said second part includes a truncated corner, said second locking tab extending from said truncated corner of said second part.

6. The package of claim 5 wherein said first locking tab is separably joined to said first part by a first line of weakening.

7. The package of claim 6 wherein said first interlocking element and said second interlocking element include an inner nesting button and an outer nesting button, said inner nesting button configured to selectively snap-lock into engagement with said outer nesting button.

8. The package of claim 7 where a force required to separate said inner and outer nesting buttons is greater than a force required to break said first line of weakening.

9. A package comprising:

a first part having a first locking tab and a pull tab, said first locking tab separably joined to said first part, said first locking tab including a first interlocking element; and a second part adapted to selectively open and close with said first part, said second part having a second locking tab, said first part and said second part being selectively closable to define an interior article-receiving space, said second locking tab including second interlocking element configured to interlock with said first interlocking element to selectively intersecure said first locking tab and said second locking tab, wherein said first part and said second part may be separated to open the package by holding said locking tabs and pulling on said pull tab, said first locking tab separating from said first part when said first part is separated from said second part, wherein said first locking tab is separably joined to said pull tab by a third line of weakening, said third line of weakening configured to allow said pull tab to separate from said first locking tab when said pull tab is pulled with sufficient force to open the package.

10. A package comprising:

a first part having a first locking tab and a pull tab, said first locking tab separably joined to said first part, said first locking tab including a first interlocking element; and a second part adapted to selectively open and close with said first part, said second part having a second locking tab, said first part and said second part being selectively closable to define an interior article-receiving space, said second locking tab including second interlocking element configured to interlock with said first interlocking element to selectively intersecure said first locking tab and said second locking tab, wherein said first part and said second part may be separated to open the package by holding said locking tabs and pulling on said pull tab, said first locking tab separating from said first part when said first part is separated from said second part, wherein said first part and said second part are interlocked by interlocking features, said interlocking features including a channel and a shoulder configured to be selectively snap-locked into said channel to close the package and wherein said first part terminates in an outer peripheral lip and said second part terminates in an outer peripheral lip, said outer peripheral lip of said second part extending farther outwardly than said outer peripheral lip of said first part.

11. The package of claim 10 wherein said first locking tab includes an outer peripheral edge and said second locking tab includes an outer peripheral edge, said outer peripheral edge of said second locking tab extending farther outwardly than said outer peripheral edge of said first locking tab.

12. The package of claim 11 wherein said first part includes a nesting recess and said second part includes a trough, whereby stacked packages are capable of nesting by fitting said trough of one package into said nesting recess of another package.

* * * * *